US006582318B1

(12) United States Patent
Halfacre

(10) Patent No.: US 6,582,318 B1
(45) **Date of Patent: *Jun. 24, 2003**

(54) GOLF TRAINING AID AND METHOD OF USE

(76) Inventor: Ronald C Halfacre, 1284 Halfacre Rd., Newberry, SC (US) 29108

( * ) Notice: Subject to any disclaimer, the term of this patent is extended or adjusted under 35 U.S.C. 154(b) by 0 days.

This patent is subject to a terminal disclaimer.

(21) Appl. No.: 10/077,389

(22) Filed: Feb. 15, 2002

Related U.S. Application Data

(63) Continuation-in-part of application No. 09/630,493, filed on Aug. 2, 2000.

(51) Int. Cl.[7] ..... A63B 57/00; A63B 69/36; A63B 53/06; A63B 53/16

(52) U.S. Cl. ..... 473/215; 473/207; 473/277; 473/266

(58) Field of Search ..... 473/276, 277, 473/212, 215, 216, 207, 265, 261, 219, 458, 464, 518; 2/24

(56) References Cited

U.S. PATENT DOCUMENTS

| | | | | |
|---|---|---|---|---|
| 2,228,586 A | | 1/1941 | Protzky | 473/518 |
| 3,190,658 A | | 6/1965 | Kane | 473/227 |
| 3,516,668 A | | 6/1970 | Kirk | 473/518 |
| 4,688,800 A | * | 8/1987 | Lopez | 473/215 |
| 4,988,100 A | | 1/1991 | Shu et al. | 473/531 |
| 5,026,066 A | | 6/1991 | Kane | 473/227 |
| 5,303,927 A | | 4/1994 | Perry et al. | |
| 5,308,074 A | | 5/1994 | Dorotinsky et al. | |
| 5,390,929 A | | 2/1995 | Todaro | |
| 5,456,470 A | | 10/1995 | Scheurer | |
| 5,687,422 A | | 11/1997 | Wurst et al. | 2/24 |
| 5,718,640 A | | 2/1998 | Noblin | 473/212 |
| 5,762,565 A | | 6/1998 | Milam et al. | 473/277 |
| 5,803,822 A | | 9/1998 | Pursell | 473/216 |
| 5,919,097 A | | 7/1999 | Cole | 473/212 |
| 5,924,933 A | | 7/1999 | Pacheco | 473/216 |
| 5,984,797 A | | 11/1999 | Kessler et al. | 473/216 |
| 6,024,656 A | | 2/2000 | Lane | 473/409 |
| 6,428,421 B1 | * | 8/2002 | Halfacre | 473/215 |

* cited by examiner

*Primary Examiner*—Paul T. Sewell
*Assistant Examiner*—Alvin A. Hunter, Jr.
(74) *Attorney, Agent, or Firm*—Michael A Mann; Nexsen Pruet Jacobs & Pollard LLC

(57) ABSTRACT

A golf training device to help maintain the proper synchronous relationship between the movement of hands and hip rotation during a golf swing. In the event that the movement of the hands and hip rotation of the user are out of synchronization, the training device provides feedback to the user. The training aid device basically comprises a strap that secure a sheet to the rearward leg of the user. A trapezoid shaped panel is mounted to the sheet, which provides the user with a reference as to the proper positioning of a user's hands and the shaft of the golf club during address, and which provides a tactile feedback signal to the user, if the user's backswing is improper or if the user's hip rotation and movement of the user's hands are out of synchronization, by making contact with at least one of the user's hands.

15 Claims, 6 Drawing Sheets

GOLF TRAINING AID AND METHOD OF USE

PRIORITY

This a Continuation-In-Part of a commonly owned, previously filed and U.S. patent application Ser. No. 09/630,493. We, therefore, claim the benefit of the priority of U.S. patent application Ser. No. 09/630,493, which was filed on Aug. 2, 2000, and which is incorporated in its entirety herein by reference.

BACKGROUND OF THE INVENTION

1. Field of the Invention

The present invention relates to golf training devices and in particular to devices for training the proper positioning of a golfer's body and golf club during set-up, and for training the proper positioning of a golfer's body and the use of proper swing mechanics during the full golf swing.

2. Discussion of Background

Golfers have made numerous attempts to enhance the consistency with which contact is made between the golf ball and the golf club. For example, timing is essential to consistently hit the ball in a relatively straight line. With regard to timing, the relative movement of the golfer's hands with respect to the rotation of the golf's hips is particularly critical. Unless the golfer is able to rotate the hips at the appropriate time, and to the appropriate extent, the club face will likely not be square at contact. However, many other factors are possibly of equal importance, such as the correct positioning of the golfer's body, especially the golfer's hands and club relative to the ball's position at set-up, which is commonly referred to as the "address" position, and the positioning of the body and the swing mechanics used during the full golf swing.

Typically, the golfer will go to a teaching pro to get advice regarding his swing. Unfortunately, this approach is very expensive since many teaching pros charge over $100 per hour for lessons. Another avenue that golfers take in hopes of achieving a more consistent game is trying the various training aids that are on the market. Again, many of these devices are very expensive to buy, are overly complex, and do not provide the required feedback needed for improving consistency in the golfer's game.

Therefore, there exists a need for a simple and inexpensive device that provides instant feedback in determining whether the proper swing mechanics are being used and that the user's body has been properly positioned starting from the address position and continuing through the full golf swing.

SUMMARY OF THE INVENTION

According to its major aspects and broadly stated, the present invention is a golf training device to help a golfer learn the proper positioning of his body and club relative to the ball's position at address, and to help maintain the proper body positioning during a full golf swing, i.e., to help maintain the synchronous relationship between the movement of the golfer's body, especially the golfer's hands and the rotation of the golfer's hips during a golf swing. In the event that the golfer's body becomes unsynchronized, the training device can provide both tactile and visual feedback signals to the user.

The present device basically comprises a belt and/or a strap that is attached to a flexible sheet in order to secure the flexible sheet to the rearward leg of the user, i.e, the rearward leg of a right-handed golfer would be the right-handed golfer's right leg while the rearward leg of a left-handed golfer would be left-handed golfer's left leg. Moreover, the device comprises at least one panel (or a pair of panels) that is attached to the outer surface of the sheet, i.e., that surface which is opposite the surface of the sheet that is in contact with the user's clothing and/or body when the device is properly attached to the user. When the panel (or pair of panels) is mounted to the sheet, the user's hands will make contact with the panel (or pair of panels) if the user's body positioning and/or swing mechanics are out of proper alignment and/or synchronization during the swing, such as if the club is taken off line during the backswing.

A major advantage of the present invention is its simplicity, both in use and structurally. A user of the present invention will be able to immediately use the device, without complex instruction; therefore, making this invention very practical for beginners. Moreover, the structural simplicity of the present invention allows for low manufacturing costs, unlike many complicated training aids.

Another important feature of the present invention is that it is lightweight, durable, and easy to store or carry, e.g., it will easily fit into a golf bag.

An important feature of the present invention is the panel (or pair of panels) mounted to the device and, therefore, to the user's leg. An advantage associated with this feature is that the panel (or pair of panels) provides instant feedback for the user. For example, during address the present invention helps define: the correct ball position; the correct position of the club and hands; and the correct angle of the golf club shaft and hands. Furthermore, the present invention also: teaches the correct take away positions of the hands, arms, and lower body; keeps the golfer aware of lower body movement, which prevents over rotation and sliding of the body; helps teach the proper positioning of the golfer's hands during the downswing, which helps prevent casting and the spinning out of the golfer's hips; teaches the proper position of the golfer's hands when the golfer is releasing the club, making impact, and completing the swing, i.e., the follow through; teaches proper weight shift during the golf swing; and provides the golfer with the feeling of correct timing associated with a good golf swing. Generally stated, the user is able to recognize many of the factors that make up a proper golf swing including the mechanics associated with hip rotation. For example, the present invention helps teach proper hip rotation by helping the golfer maintain the simultaneous relationship between the movement of the hands and hip rotation during the golf swing, e.g., the hips must be rotated sufficiently so that the hands do not contact the panel (or pair of panels) during the downswing.

Other features and advantages of the present invention will be apparent to those skilled in the art from a careful reading of the Detailed Description of Preferred Embodiments presented below and accompanied by the drawings.

DETAILED DESCRIPTION OF PREFERRED EMBODIMENTS

Figure 1:
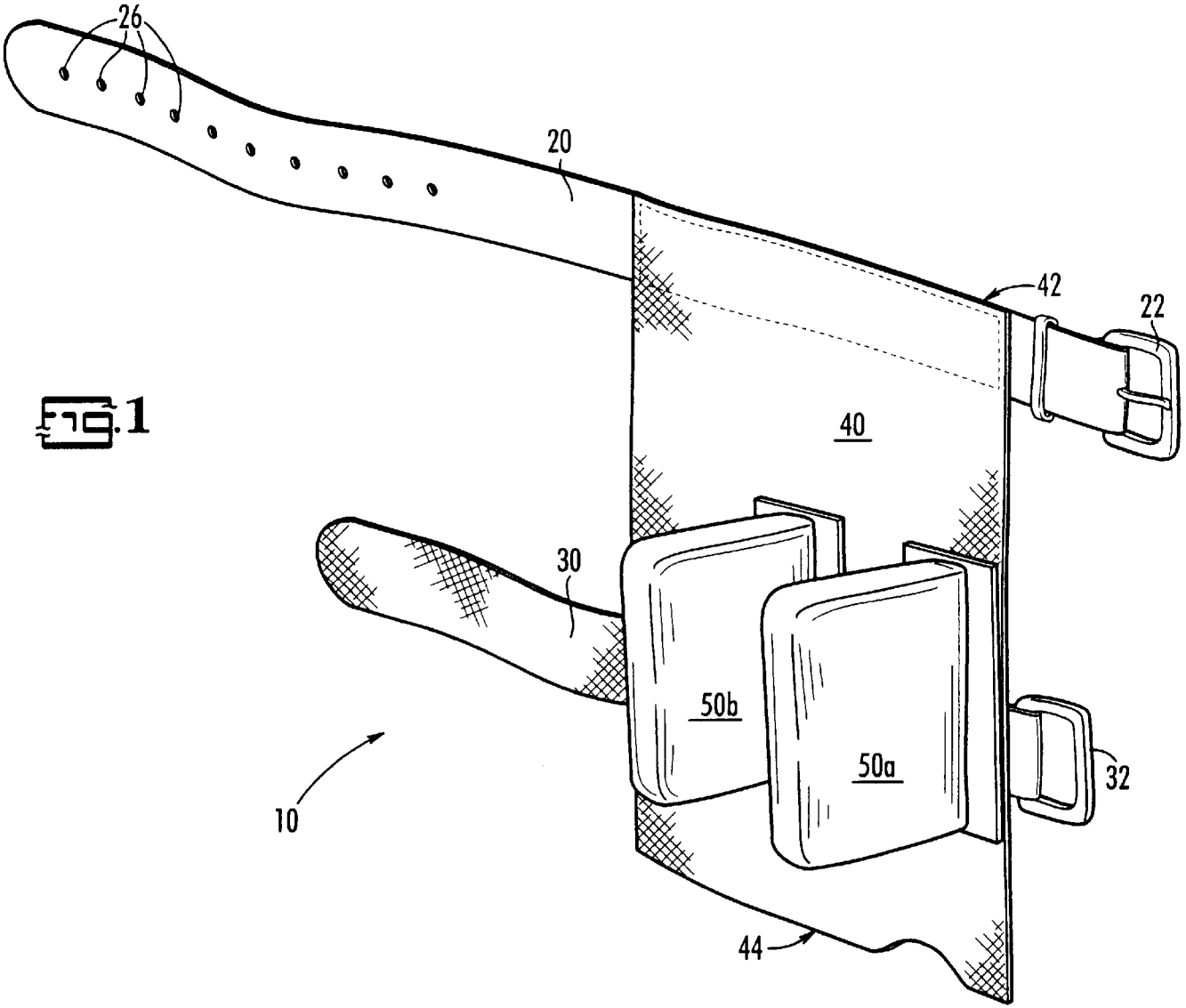
FIG. 1 is a perspective view of a golf training aid, according to a preferred embodiment of the present invention.

When the terms "hook and loop fastener" or "hook and loop fastener strips" are used, in either their singular or plural forms, herein, they refer to a type of fastener consisting of two strips, one with a dense layer of hooks and the other with a dense layer of loops, i.e., a fastener of the type commonly used on outerwear, athletic shoes, and luggage. Also, whenever the term "hook and loop fastener strip," in either its singular or plural form, is used in association with the function of fastening and/or connecting objects and/or parts of objects to each other herein, it implies that one of the objects and/or parts will have a strip carrying a dense layer of hooks and the other object and/or part will have a strip carrying a dense layer of loops so that when the loop strip is pressed against the hook strip the fastening and/or connecting function can be achieved. In some circumstances, for fastening and/or connecting purposes, a single object and/or part of the present invention may have both a hook strip and a loop strip attached.

The present invention is a golf training device. Referring now to FIGS. 1–6, device 10, among other features, helps to maintain the proper synchronous relationship between the movement of the hands 130 and the rotation of the user's hips during a golf swing. In the event that the movement of the hands 130 and hip rotation of the user are out of synchronization, the device 10 provides tactile and visual feedback to the user. Device 10 basically comprises a belt 20 and strap 30 that secure a sheet 40 to the rearward leg 120 of the user 100, i.e, the rearward leg of a right-handed golfer would be the right-handed golfer's right leg while the rearward leg of a left-handed golfer would be left-handed golfer's left leg. A pair of panels 50*a* and 50*b* are mounted to the sheet 40, and one or both panels of the pair of panels 50*a* and 50*b* makes contact with either or both of a user's hands 130 if the hip rotation and the movement of the user's hands 130 are out of synchronization with each other.

Figure 2:
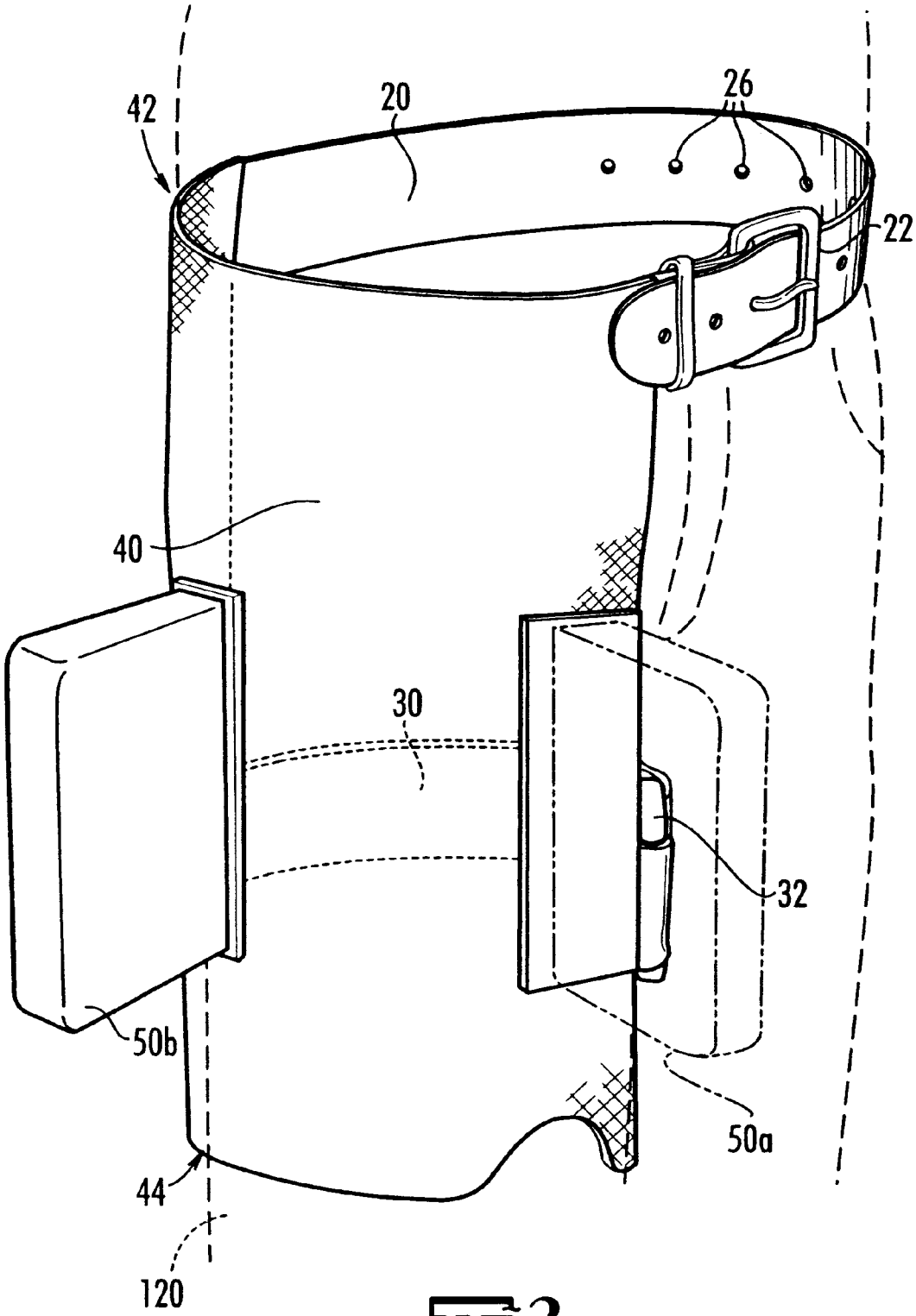
FIG. 2 is a perspective view of a golf training aid attached to a user, according to a preferred embodiment of the present invention.

Referring to FIG. 1, device 10 has a sheet 40 that can be attached to a user using a belt 20 and a strap 30. Belt 20 is attached to the top end 42 of the sheet 40 while the strap 30 is attached to the bottom end 44 of the sheet 40. Belt 20 has a buckle 22 on the first end and a plurality of holes 26 on the second end. Belt 20 functions like a standard belt and is capable of being wrapped around the waist of a user so that the first end and the second end can be fastened together. Strap 30 is capable of being wrapped around the rearward leg 120 of the user 100 so that the bottom end 44 of the sheet 40 is secured to the rearward leg 120 of the user 100 as illustrated in FIG. 2. Strap 30 has a first end with hook and loop fasteners and a second end with a clasp 32. First end of strap 30 is capable of being received through clasp 32 and secured using the hook and loop fasteners. Sheet 40 may be secured to a user 100 as illustrated in FIG. 2.

A first panel 50*a* and second panel 50*b* are mounted to the sheet 40. Panels 50*a* and 50*b* may be mounted to the sheet 40 using a variety of techniques, however, panels 50*a* and 50*b* preferably are attached to the sheet 40 using hook and loop fasteners. Panels 50*a* and 50*b* have a major dimension that extends away from the rearward leg 120 of the user 100 when panels 50*a* and 50*b* are mounted to the rearward leg 120 of the user 100. First panel 50*a* is preferably mounted to sheet 40 so that first panel 50*a* extends in a direction perpendicular to the golf ball's intended flight path, as illustrated in FIG. 2. The term "intended flight path" means the horizontal straight line path between the user and the intended target. Second panel 50*b* is preferably mounted in a position perpendicular to first panel 50*a*.

Figure 4:
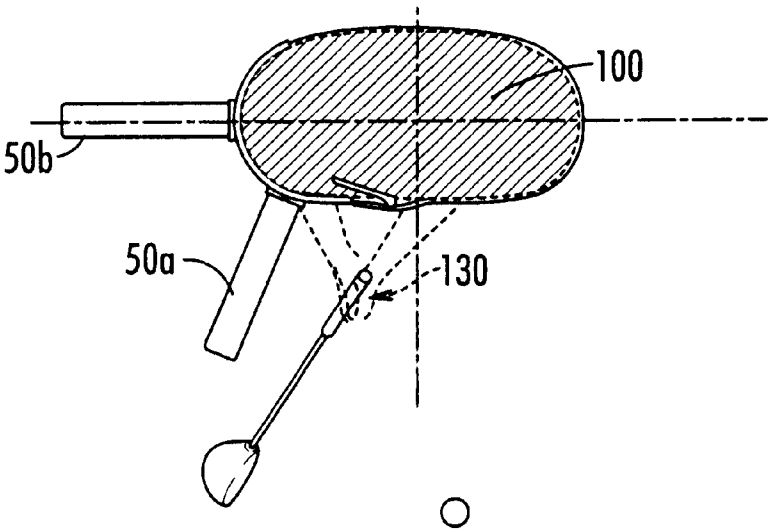
FIG. 4 is a top view of a user using the golf training aid during the initial portion of the backswing, according to a preferred embodiment of the present invention.
Figure 3:
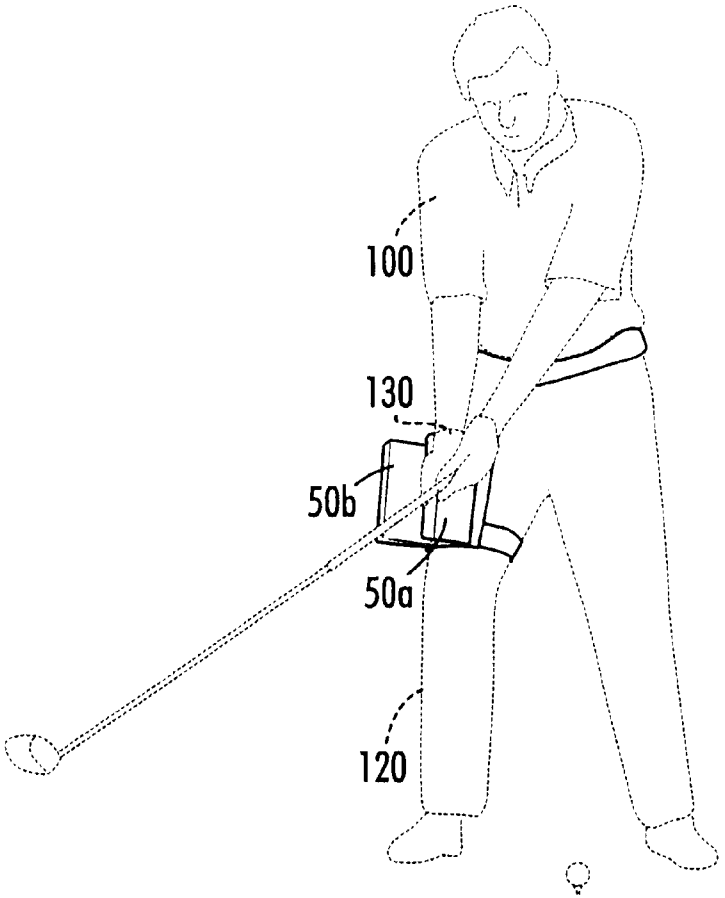
FIG. 3 is a front perspective view of a user using the golf training aid during the initial portion of the backswing, according to a preferred embodiment of the present invention.

Referring to FIGS. 3 and 4, there is shown the relative position of user's hands 130 with respect to the first panel 50*a* when the user 100 is initially starting the backswing. Preferably, the backswing of the user 100 is on a line that allows user's hands 130 to clear the first panel 50*a*; otherwise, the hands 130 of the user 100 will make physical contact with the first panel 50*a*. In other words, the user's hands 130 will contact the first panel 50*a* if the proper swing path is not taken.

Figure 6:
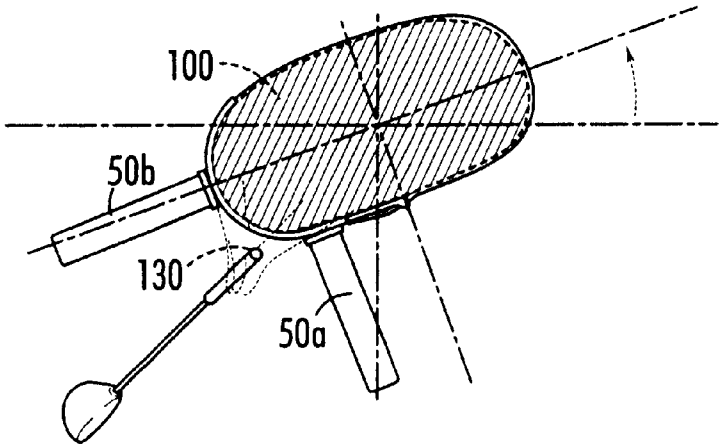
FIG. 6 is a top view of a user using the golf training aid during the follow through of the swing, according to a preferred embodiment of the present invention.
Figure 5:
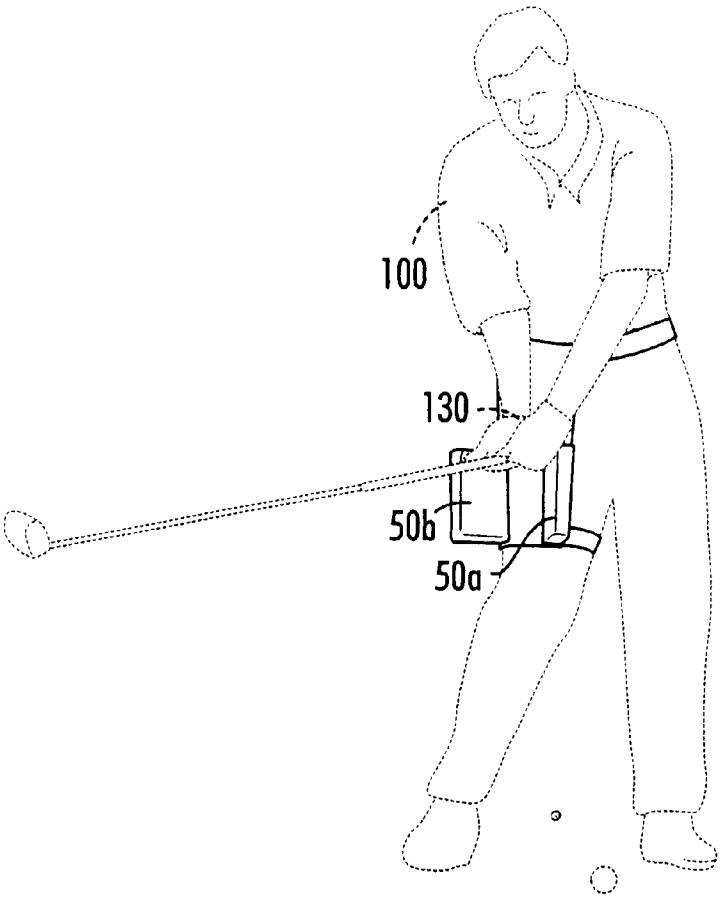
FIG. 5 is a front perspective view of a user using the golf training aid during the follow through portion of a golf swing, according to a preferred embodiment of the present invention.

Referring to FIGS. 5 and 6, the first panel 50*a* and the second panel 50*b* are positioned on the sheet 40 such that the user's hands 130 pass between the first panel 50*a* and the second panel 50*b* during a portion of the forward swing without contacting either the first panel 50*a* or the second panel 50*b*. In the event that the user does not properly time the rotation of the user's hips with the movement of the user's hands 130, the user's hands 130 will contact either the first panel 50*a* or the second panel 50*b*, giving the user 100 immediate tactile feedback regarding the user's 100 improper hand and/or hip positioning, and/or the other problems associated with the user s swing mechanics.

Referring now to FIGS. 7A–11, another preferred embodiment of the present invention is shown. Single-panel device 200 is also detachably secured to a user's leg, and also is able to provides instant feedback to the user 100. Single-panel device 200 helps to teach the mechanics associated with a proper golf swing through many different checks. For example, the present invention helps define: the correct ball position; the correct position of the club and hands; and the correct angle of the golf club shaft and hands, when the golfer is addressing the ball. Furthermore, the present invention also: teaches the correct take away positions of the hands, arms, and lower body; keeps the golfer aware of lower body movement, which prevents over rotation and sliding of the body; helps teach the proper positioning of the golfer's hands during the downswing, which helps prevent "casting," i.e., an early or improperly positioned release of the golf club during the forward swing, and the "spinning out" of the golfer's hips, i.e., an improper hip motion during the golf swing; teaches the proper position for the golfer's hands when the golfer is releasing the club, making impact, and completing the swing during follow through; teaches proper weight shift during the golf swing; and provides the golfer with what it feels like to have the correct timing during the golf swing. Generally stated, the user is able to recognize many of the factors that make up a proper golf swing including the mechanics associated with hip rotation. As an example, the present invention helps teach proper hip rotation by helping the golfer maintain the proper simultaneous relationship between the golfer's hands and the rotation of the golfer's hips during the golf swing, e.g., the hips must be rotated sufficiently so that the hands do not contact the single-panel device 200 during the downswing.

Still referring to FIGS. 7A–11, and as previously mentioned, if the movement of the user's hands 130 and the rotation of the user's hips 240 are out of synchronization, the single-panel device 200 provides tactile and/or visual feedback to the user. More specifically, the single-panel device 200 basically comprises a flexible leg strap 210 that secures a flexible sheet 220 to the rearward leg 120 of the user 100, i.e, the rearward leg of a right-handed golfer would be the right-handed golfer's right leg while the rearward leg of a left-handed golfer would be left-handed golfer's left leg. A panel 280 is mounted to the sheet 220, and if the hip rotation 240 and the movement of the user's hands 130 are out of synchronization with each other the panel 280 makes contact with either or both of a user's hands 130; thereby, providing the user with a tactile signal of an improper golf swing.

Figure 7A:
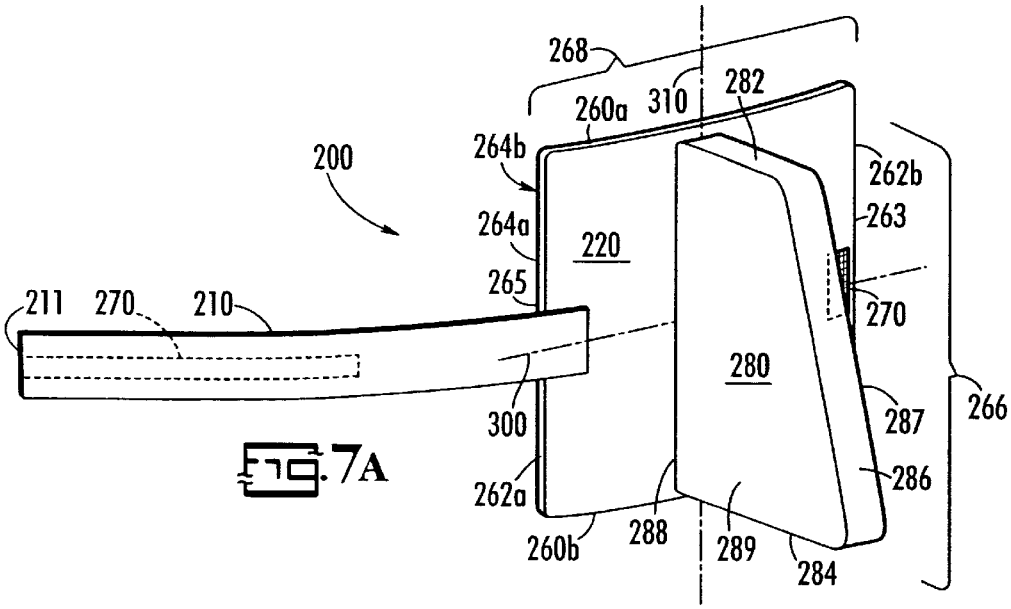
FIG. 7A is a front perspective view of a golf training aid, according to another preferred embodiment of the present invention.

Referring specifically to FIG. 7A, the single-panel device 200 has a flexible sheet 220 that can be attached to a user 100 using a flexible leg strap 210. Preferably, the sheet 220 is made of a flexible material such as plastic, cotton, nylon, or a blend of these or similar materials; however, the sheet 220 may be made of any other suitable lightweight, preferably, elastic material or fabric, and may be padded for better fit and/or additional comfort. From the perspective of the single-panel device 200 being attached to a user 100, the sheet 220 has a top end 260*a* that is located above the horizontal centerline 300, and an opposing bottom end 260*b* that is located below the horizontal centerline 300, a right side 262*a*, which is located to the right of the vertical centerline 310, and an opposing left side 262*b*, which is located to the left of the vertical centerline 310, and a front surface 264*a* and an opposing rear surface 264*b*. A vertical dimension 266 runs in the direction of the vertical centerline 310 between the top end 260*a* and the bottom end 260*b*, and a horizontal dimension 268 runs in the direction of the horizontal centerline 300 between the right side 262*a* and the left side 262*b*. The sheet 220 is substantially rectangular; preferably however, the sheet 220 is about eight (8") inches in length along its horizontal dimension 268, about nine (9") inches in length along its vertical dimension 266, and at least about one-eighth (0.125") of an inch in depth.

Figure 7B:
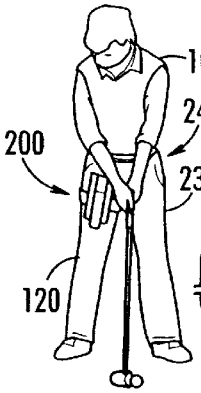
FIG. 7B is a front perspective view of the golf training aid being worn by a right handed user, according to the preferred embodiment of the present invention shown in FIG. 7A.
Figure 7C:
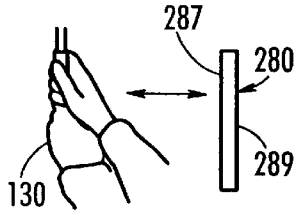
FIG. 7C is a partial top plan view of the golf training aid showing the position of a right handed golfer's hands relative to the training aid at address, according to the preferred embodiment of the present invention shown in FIG. 7A.
Figure 7D:
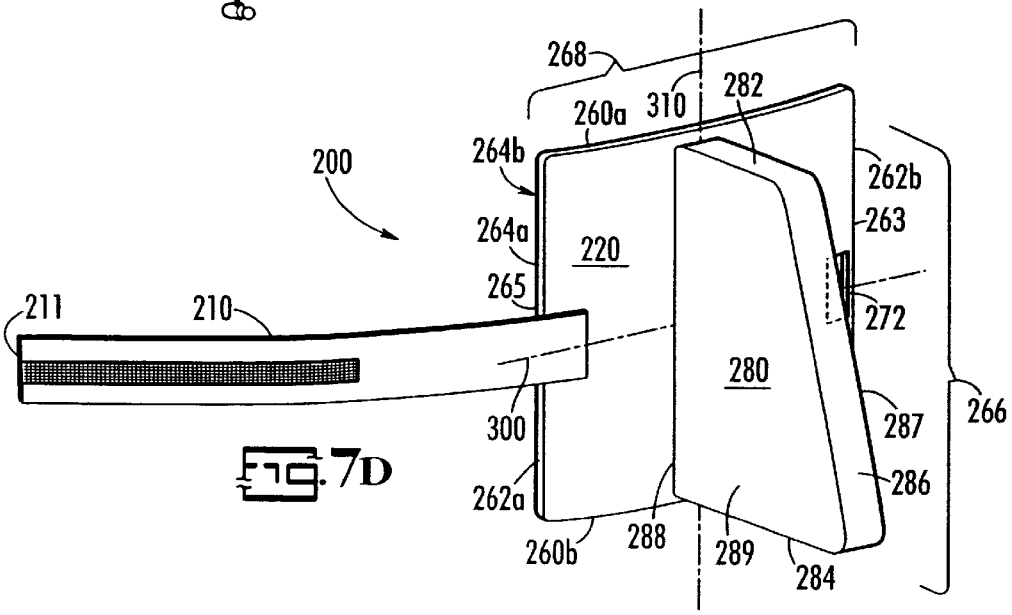
FIG. 7D is a front perspective view of a golf training aid, according to another preferred embodiment of the present invention.
Figure 8A:
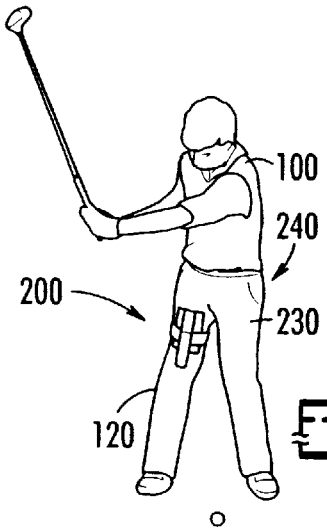
FIG. 8A is a front perspective view of the golf training aid during the take away portion of the backswing, according to the preferred embodiment of the present invention shown in FIG. 7A.
Figure 8B:
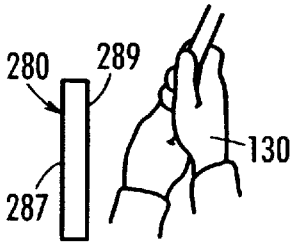
FIG. 8B is a partial top plan view of the golf training aid showing the position of a right handed golfer's hands, and the training aid relative to the ball's position during the take away portion of the backswing, according to the preferred embodiment of the present invention shown in FIG. 7A.
Figure 9:
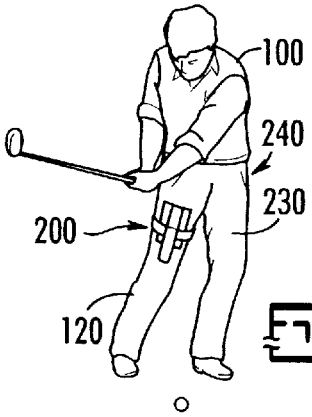
FIG. 9 is a front perspective view of the golf training aid during a portion of the backswing, according to the preferred embodiment of the present invention shown in FIG. 7A.
Figure 10A:
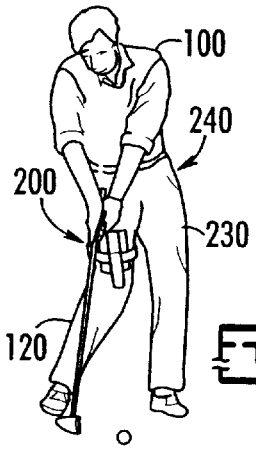
FIG. 10A is a front perspective view of the golf training aid during a portion of the downswing, according to the preferred embodiment of the present invention shown in FIG. 7A.
Figure 10B:
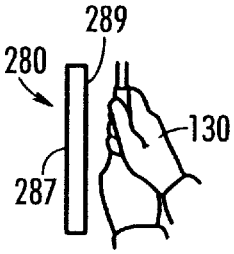
FIG. 10B is a partial top plan view of the golf training aid showing the position of a right handed golfer's hands, and the position of the training aid relative to the ball's position during a portion of the forward swing, according to the preferred embodiment of the present invention shown in FIG. 7A.
Figure 11:
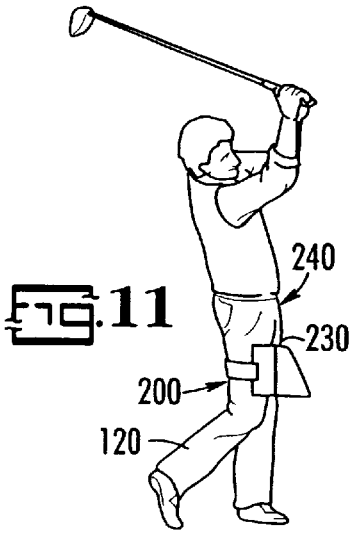
FIG. 11 is a front perspective view of the golf training aid during a part of the forward swing, according to the preferred embodiment of the present invention shown in FIG. 7A.

Preferably, as previously mentioned, the sheet 220 is attached to the user 100 through the use of a flexible leg strap 210. Preferably, the flexible leg strap 210 is about twenty (20") inches in length, at least about one (1.0") inch in width, and at least about one-eighth (0.125") of an inch in depth, and is made of the same, or a similar, material that is used to make the sheet 220; however, any other suitable material can be used including leather and/or resilient materials such as rubber, and the leg strap 210 may be padded for better fit and/or additional comfort. The flexible leg strap 210 can be made to be adjustable through the use of: at least one releasable hook and loop fastening strip 270, which may be sewn onto the flexible leg strap 210 and/or sheet 220; and/or a belt buckle-like fastener or clasp, which can be similarly attached to the leg strap 210 and/or sheet 220. Preferably, one end of the leg strap 210 is attached to the flexible sheet 220 by being sewn to the right side 262*a* of the sheet, on or near the right side edge 265, about halfway between the top side 260*a* and the bottom side 260*b*, a hook and loop fastener strip 270 is sewn onto the left side 262*b* of the sheet 220 and on the rear surface of the leg strap 210 (as shown in FIG. 7A), or a hook and loop fastener strip 270 is sewn onto the front surface of the leg strap 210 and a leg strap slot 272 is formed on the left side 262*b* at or near the left side edge 263 of the flexible sheet 220 (as shown in FIG. 7D). The leg strap slot 272 is dimensioned so that it is slightly larger than the width of the leg strap 210, and it is reinforced so that the non-attached end 211 of the leg strap 210 can be inserted through the slot 272 after being placed around the user's rearward leg 120. Then, after inserting the leg strap 210 through the slot 272, the leg strap is adjusted by pulling on the end 211 of the strap until the single-panel device 200 is comfortably snug against the user's rearward leg 120, and then the leg strap 210 is pressed against itself so that the hook and loop fasteners on the hook and loop fastener strip 270 form a secure attachment connection. In another similar embodiment, instead of having a slot 272, a hook and loop fastener strip 270 is attached to the front surface 264*a* on the left side 262*b* of the sheet 220, at or near the left side edge 263, and the hook and loop fastener strip 270, on the leg strap 210 itself, is attached to the bottom surface of the leg strap 210. The leg strap 210 would again be pulled around the user's rearward leg 120 until it was snug and then the hook and loop fastener strip 270 of the leg strap 210 would be pressed against the hook and loop fastener strip 270 attached to the sheet 220 in order to form a secure, yet comfortable, attachment connection.

Other suitable methods can be used to provide attachment of the single-panel device 200 to the user's rearward leg 120 including the use of a belt-like leg strap, (not shown), with the strap being attached to the front surface 264*a* on either side of the sheet and the buckle being attached to the opposite side. The belt-like leg strap would function like a standard belt and would be capable of being wrapped around the user's rearward leg so that the end of the leg strap having a plurality of holes could be fastened to the buckle. In another fastening embodiment, the leg strap 210 is attached to the sheet 220 and has the hook and loop fastener strip 270 attached to its front surface as previously described, but, instead of having a slot 272, a strap ring, (not shown), is attached to the sheet 220, preferably by looping a strip of material around the strap ring and then attaching both ends of the material to the sheet 220, (preferably by sewing the ends of the material to the front surface 264*a* of the sheet 220 at or near the left side edge 263 of the flexible sheet 220). The end 211 of the leg strap 210 should be capable of being received through, and looped around, the strap ring. The leg strap is then adjustable by pulling on the end 211 of the strap until the single-panel device 200 is comfortably snug against the user's rearward leg 120, and then the leg strap 210 would be pressed against itself so that the hook and loop fasteners on the hook and loop fastener strip 270 form a secure attachment connection. (Another version of this would include two strap rings, which would be used in a manner similar to that of motorcycle helmet straps.)

Another means of attachment of the single-panel device 200 to the user's leg may be accomplished by forming the flexible and/or elastic material used to make the sheet 220 into a one-piece, generally cylindrically shaped, configuration, which would not require the use of a leg strap 210 at all since the single-panel device 200 could be pulled over the user's foot and leg, and into the proper position around the user's thigh.

Attached to the sheet 220, preferably at or near the vertical centerline 310 is a panel 280, which may be attached to the sheet 220 through the use of any of a variety of techniques including gluing and/or sewing. Preferably, however, the panel 280 is attached to the sheet 220 using hook and loop fastener strips 270, which are attached to the sheet 220 and to the panel 280. The panel 280 has a top end 282 and an opposing bottom end 284, a back 288 and an opposing front end 286, and a left side 287 and an opposing right side 289. Preferably, the front end 286 is angled, i.e., the panel is not rectangular. Preferably, the back 288 conforms to the shape of the sheet 220, which becomes curved as the sheet 220 is being attached to the user's rearward leg 120; however, this curvature is not a necessity. The back 288 is dimensioned so that it is slightly smaller in length along its major dimension than the vertical dimension 266 of the sheet 220. Preferably the top end 282 of the panel 280 is about five and one-quarter (5.25") inches in length and extends away from the sheet 220 at an angle that is almost perpendicular to the front surface 264*a* of the sheet 220, while the bottom end 284 of the panel 280 is about seven and one-half (7.5") inches in length and extends away from the sheet 220 at an angle that is also almost perpendicular to the front surface 264*a* of the sheet 220. Therefore, in its preferred embodiment, the difference between the length of the top end 282 and the length of the bottom end 284 of the panel 280 causes the front end 286 of the panel 280 to be held at an angle, i.e., the front end 286 and the back 288 are not parallel to each other. While the preferable dimensions for all of the parts of the present invention have been described herein, other versions of the present invention may be fabricated having dimensions and angles that are more suitable for junior, i.e, shorter and/or smaller, golfers or for significantly taller and/or larger golfers. In other words, the sheets 40 and 220, the leg strap 210, the belt 20, and/or the panels 50*a*, 50*b* and 280 may be dimensioned to accommodate either shorter, smaller, larger, and/or taller golfers.

The panel 280 is preferably made of foam rubber that is enclosed within a washable material that is sewn together to contain the foam rubber, and the panel 280 has a hook and loop strip 270 attached to the portion of the material that covers the back 288 of the panel 280 so that the panel 280 can be detachably fastened to the sheet 220, which also has at least one hook and loop strip 270 attached to the sheet's front surface 264*a* to effectuate said fastening. However, the panel 280 may be made of any other suitable material that is lightweight and durable and is able to keep its angled shape including plastic and/or rubber, and the panel 280 may be permanently attached to the sheet 220 by any suitable method including gluing and/or sewing. In either form of attachment, the panel 280 is preferably attached to the sheet 220 in a way that causes the panel 280 to be centered on or near the vertical centerline 310 of the sheet 220, and also causes the panel 280 to extend radially away from the sheet 220 from that attachment point.

Referring to FIG. 7A—11, when using the single-panel device 200, it is recommended that a user practices their golf swing by using a 7 iron; however, if preferred by the user, other clubs can be used.

The following directions regarding the use of the single-panel device 200 are written from the perspective of the single-panel device 200 being used by a right-handed golfer; therefore, if a left-handed golfer is using the device 200 the user and/or the reader should make the appropriate perspective adjustments between "left side" and "bright side" and vice versa.

The user 100 would attach the panel 280 to the sheet 220, if not already attached, by pressing the hook and loop fastener strip 270 attached to the back 288 of the panel 280 to the hook and loop fastener strip 270 attached to the front surface 264*a* of the panel 280, and the user 100 would then position the single-panel device 200 on their rearward leg 120 so that the bottom end 284 of the panel 280 is about two (2") inches above the user's knee on the user's rearward leg. In the proper position, the panel 280 is centered with respect to the knee on the user's rearward leg, and the front end 286 of the panel 280 is extended away from the sheet 220 and, therefore, the user's leg 120. Generally, the user 100 will be able to center the panel 280 by centering it with respect to the crease on the user's rearward pant leg. To keep the device 200 from slipping during use, the user 100 should securely, yet comfortably, attach the single-panel device 200 to the user's rearward leg 120 by using the fastening devices provided, e.g., the leg strap 210. When addressing the ball, i.e, the set-up position, the panel 280 is preferably mounted to the sheet 220 so that the panel 280 extends in a direction perpendicular to the golf ball's intended flight path, as illustrated in FIGS. 7B and 7C, the golfer's hands 130 should fall in a position that is at, or near, the center of the panel 280 and about five (5") inches to the left of the left side 287 of the panel 280. Additionally, during set-up, the user 100 should set the shaft of the club being used at an angle that is about the same angle formed by the angled front end 286 of the panel 280. During the take away, i.e., the beginning of the backswing, the club and hands 130 should be taken back without touching the panel 280 and, as much as possible, the panel 280 should not move from its initial starting position until the user's hands 130 have passed to the right side 289 of the panel 280. As a training note, to ensure a "quiet," i.e., non-moving, lower body during the backswing, the single-panel device 200 should stay within an imaginary plane that lies at the outside of the foot of the rearward leg 120 and is perpendicular to the ground and the intended flight path of the ball.

The user 100, after completing the backswing would then start the downswing, and would let his hands 130 fall into a position to the right of the right side 289 of the panel 280. In this position, the heel of the rearward leg 120 should begin to lift, but not turn, in order to ensure a proper golf swing weight shift. Then, just before impact with the ball, the hands 130 should be just to the right side 289 of the panel 280, i.e., the hands 130 should be close to the panel 280 but should not be touching the panel 280.

Furthermore, during this portion of the golf swing it is very important that the hands 130 do not pass too far away from the golfer's body, i.e, the hands 130 should not be swung around the angled front end 286 of the angled panel 280. After contact with the ball, the hands 130 should continue to follow the single-panel device 200 as the body and, therefore, the single-panel device 200 turns toward the intended target, and the heel of the rearward leg 120 should start to pivot away from the intended target while keeping the forward leg 230 straight. Finally, the follow-through or completion of the golf swing position of the user 100 should have the angled end 286 of the single-panel device 200 pointing toward the target, i.e., in a direction that is parallel to the target, the foot of the rearward leg 120 should be pivoted on the big toe of the foot of the rearward leg 120, and the heel of the rearward leg 120 should be raised up and pointing away from the intended target.

It will be apparent to those skilled in the art that many changes and substitutions can be made to the preferred embodiment herein described without departing from the spirit and scope of the present invention. Therefore, while the preferred embodiments and the best mode of the present invention are described herein, it should be understood that the best mode for carrying out the invention described is by way of illustration and not by way of limitation. It is intended that the scope of the present invention include all modifications that incorporate its principal design features, and that the scope and limitations of the present invention are to be determined by the scope of the appended claims and their equivalents.

What is claimed is:

1. A golf training aid for use by a golfer when hitting a golf ball with a golf club, said training aid comprising:

a sheet having a top end and a bottom end;

a means for attaching said sheet to a golfer; and a panel mounted to said sheet having a panel front end and an opposing panel back end, a panel top end and an opposing panel bottom end, said attaching means causing said sheet and said panel to rotate with the hips of said golfer during a golf swing, said panel moving from a position perpendicular to the intended flight path of a golf ball to a position parallel to the intended flight path of said golf ball as said golfer swings, said panel being positioned on said sheet so that said golfer does not make contact with said panel during a proper golf swing, said panel dimensioned to make contact with said golfer when an improper golf swing is made so that said golfer receives tactile feedback from said panel as an indication of said improper golf swing, wherein said panel is dimensioned so that the length of said panel top end when measured from said panel back end to said panel front end is less than the length of said panel bottom end when measured from said panel back end to said panel front end.

2. The golf training aid as recited in claim 1, wherein said panel is mounted to said sheet along only said panel back edge.

3. The golf training aid as recited in claim 1, further comprising means for detachably mounting said panel to said sheet.

4. The golf training aid as recited in claim 3, wherein said mounting means are hook and loop fasteners.

5. The golf training aid as recited in claim 2, wherein said panel extends between about 2 to 10 inches from said sheet when said panel is mounted to said sheet.

6. The golf training aid as recited in claim 5, wherein said panel is between about 2 to 10 inches in length from said panel top end to said panel bottom end.

7. The golf training aid as recited in claim 1, wherein said panel is formed to provide an indication of the proper positioning of a golf club shaft during set-up.

8. The golf training aid as recited in claim 1, wherein said panel is formed to provide an indication of the proper positioning of a golfer's hands during set-up.

9. The golf training aid as recited in claim 1, wherein said panel is a trapezoid with said panel top end and said panel bottom end parallel to each other, and said panel back end perpendicular to both said panel top panel end and said panel bottom end.

10. The golf training aid as recited in claim 1, wherein said attaching means is a leg strap.

11. The golf training aid as recited in claim 10, wherein said leg strap carries hook and loop fasteners.

12. The golf training aid as recited in claim 1, wherein said tactile feedback from said panel comprises:

an improper backswing tactile signal, said improper backswing tactile signal being provided by said panel contacting at least one hand of said golfer during an improper backswing; and an improper forward swing tactile signal, said improper forward swing tactile signal being provided by said panel contacting at least one hand of said golfer during an improper forward swing.

13. A golf training aid, said training aid comprising:

a strap capable of attachment to the leg of a user;

a sheet carried by said strap; and a panel mounted to said sheet having a front end and an opposing back end, and a top end and an opposing bottom end, for signaling that said user has moved a club during a backswing in a path that is not parallel with the intended ball flight path and for signaling that said user has insufficient hip rotation during a forward swing, said front end of said panel distal to said sheet and said back end proximal to said sheet, said panel radially extending from said sheet when said panel is mounted to said sheet wherein said panel is a trapezoid having said top end and said bottom end parallel to each other, and said back end perpendicular to both said top end and said bottom end, so that said front end forms an angle that provides said user with a reference as to proper golf club shaft angle during address.

14. The golf training aid as recited in claim 13, wherein said panel extends from said sheet in a direction perpendicular to the intended ball flight path during set-up.

15. The golf training aid as recited in claim 13, wherein said panel is removably attached to said sheet.

* * * * *